United States Patent [19]

Withers et al.

[11] 4,338,177

[45] Jul. 6, 1982

[54] ELECTROLYTIC CELL FOR THE PRODUCTION OF ALUMINUM

[75] Inventors: James C. Withers, Strongsville; Gary V. Upperman, North Olmsted, both of Ohio

[73] Assignee: Metallurgical, Inc., Lakewood, Ohio

[21] Appl. No.: 62,135

[22] Filed: Jul. 30, 1979

Related U.S. Application Data

[63] Continuation-in-part of Ser. No. 944,987, Sep. 22, 1978, abandoned, and Ser. No. 52,578, Jun. 27, 1979, abandoned.

[51] Int. Cl.[3] ..... C25C 3/06; C25C 3/12; C25C 3/24; C25C 7/02

[52] U.S. Cl. ..... 204/243 R; 204/245; 204/290 R; 204/294

[58] Field of Search ..... 204/67, 243 R, 251, 204/294, 295, 245, 290 R

[56] References Cited

U.S. PATENT DOCUMENTS

| | | | |
|---|---|---|---|
| 503,929 | 8/1993 | Hall | 204/67 |
| 2,552,423 | 5/1951 | Glazunov | 204/67 |
| 3,400,061 | 9/1968 | Lewis et al. | 204/67 |
| 3,502,553 | 3/1970 | Gruber | 204/67 |
| 3,798,140 | 3/1974 | Sullivan et al. | 204/67 |
| 4,093,524 | 6/1978 | Payne | 204/67 |
| 4,115,215 | 9/1978 | Dac et al. | 204/67 |
| 4,118,292 | 10/1978 | Fray | 204/67 |
| 4,231,853 | 11/1980 | Rahn | 204/243 R |

FOREIGN PATENT DOCUMENTS

| | | | |
|---|---|---|---|
| 4087 | of 1879 | United Kingdom | 204/67 |
| 2888 | of 1883 | United Kingdom | 204/67 |
| 16794 | of 1889 | United Kingdom | 204/67 |
| 483068 | 7/1936 | United Kingdom | 204/67 |
| 452269 | 8/1936 | United Kingdom | 204/70 |
| 508814 | 7/1939 | United Kingdom | 204/70 |
| 511076 | 8/1939 | United Kingdom | 204/67 |
| 561651 | 5/1944 | United Kingdom | 204/70 |

OTHER PUBLICATIONS

Minet, "The Production of Aluminum" (1905) p. 245.

Edwards et al., The Aluminum Industry (1930) vol. 1, p. 12.

Good et al., Electrodeposition of Aluminum From Fused-Salt Electrolytes Containing Aluminum Chloride (U.S. Dept. of Interior Report) pp. 1-3.

*Primary Examiner*—Howard S. Williams

*Attorney, Agent, or Firm*—Laurence R. Brown

[57] ABSTRACT

A cell for the electrolytic deposition of aluminum at low temperatures and low electrical potential in which the anode is the sole source of aluminum and comprises a composite mixture of an aluminous material such as aluminum oxide and a reducing agent. Conductor means of higher electrical conductivity than the mixture are provided to conduct substantially the entire anodic current to the active anode surface thereby reducing the voltage drop through the highly resistive composite mixture. The mixture may be employed in a self-baking mode or be prebaked. Alternatively, the mixture may be in a particulate form and contained within a porous membrane which passes the electrolyte or other dissolved material while withholding undissolved impurities. The cell may have bipolar electrodes and may be used in combined winning and refining configurations.

22 Claims, 15 Drawing Figures

ELECTROLYTIC CELL FOR THE PRODUCTION OF ALUMINUM

RELATED APPLICATION

This Application is a continuation-in-part of our earlier Application Ser. No. 944,987 filed Sept. 22, 1978, now abandoned, and Ser. No. 052,578 filed June 27, 1979, now abandoned.

Aluminum also may be electrodeposited from aluminum oxide to produce molten metal, at a temperature as low as the melting point of the metal and with the use of an all fluoride containing bath and an anode containing aluminum oxide and reducing agent.

Energy saving cells for the electrodeposition of aluminum have a reduced anode-cathode spacing to as low as 0.25 inch with the use of unique pieces of conductive refractory hard metal, such as $TiB_2$ extending above the pool of molten metal thus forming the cathode. Combined winning and refining cells may have one or two compartments and may use the porous membrane to form a compact design for electrodeposition of aluminum from an impure source and subsequent refining within the same cell.

FIELD OF THE INVENTION

This invention relates to the electrolytic production of aluminum from aluminum oxide using a bath containing halides; more particularly, the present invention relates to continously reproducing aluminum chloride using a unique anode while depositing aluminum at the cathode. Also, aluminum may be deposited by the electrolytic deposition of the metal from aluminum oxide at energy saving low temperatures and low electrical potentials.

BACKGROUND OF THE INVENTION

The commercial production of the aluminum in the world has been by the Hall-Heroult process. In this well-known process a purified source of alumina is dissolved in a molten all fluoride salt solvent, primarily consisting of cryolite and then reduced electrolytically with a carbon anode according to the reaction $$\tfrac{1}{2}\,Al_2O_3+\tfrac{3}{4}\,C+3e\rightarrow Al+\tfrac{3}{4}\,CO_2$$

$$\tfrac{1}{2}\,Al_2O_3+3/2\,C+3e\rightarrow Al+3/2\,CO.$$

Three characteristics of this system which are inherent in the Hall-Heroult process include: first, carbon dioxide is produced and the carbon anode is consumed at the rate of 0.33 to 1 pound of carbon per pound of aluminum produced which results in a required continual movement of the carbon anode downwardly toward the cathode aluminum pool at the bottom of the cell to maintain constant spacing for uniform aluminum production and thermal balance in the cell; second, the need to feed intermittently and evenly the solid alumina in a limited concentration range to the "open type" cell to maintain peak efficiency of operation in order to avoid "anode effects"; third, severe corrosion of cell materials due to the high temperatures of 950°-1000° C. and the fluoride salts resulting in low cell life and increased labor.

A fourth characteristic not inherent in the system but present nonetheless is that the cell power efficiency is limited to less than 50% due to the practical requirement of maintaining a carbon anode to liquid aluminum distance greater than one inch to reduce the magnetic fields' undulation of the aluminum layer causing intermittent shorting with resultant Faradaic losses due to the back reaction of aluminum droplets with carbon dioxide, $$Al+3/2\,CO_2\rightarrow\tfrac{1}{2}\,Al_2O_3+3/2\,CO.$$

The first three inherent limitations of the conventional Hall-Heroult process can potentially be overcome either by use of an aluminum chloride electrolysis process which in the prior art would directly produce aluminum and chlorine gas or through the use of all fluoride bath at temperatures of 700°-750° C. for the direct reduction of aluminum oxide.

The potential advantages of an aluminum chloride salt electrolysis process include: (1) the use of chloride salts which are more economical than the fluorides of the Hall-Heroult salts, have a lower operating temperature of 700°-800° C. and are much less corrosive. This results in more economical cell construction materials with an attendant longer cell life; (2) the aluminum chloride electrolysis process requires a closed system reducing air pollution problems; (3) the chloride electrolytes, even at the lower operating temperature of 700°-800° C., have higher conductivities than that of the Hall-Heroult fluoride salts at 950°-1000° C. This results in the production of aluminum at lower energy consumption and at higher power and current efficiencies; (4) the use of the aluminum chloride electrolysis process has a very broad operating range of aluminum concentration which results in no "anode effect"; (5) it is possible to design the aluminum chloride electrolytic process cell with bipolar electrodes which result in a much more compact cell with increased production potential per unit volume.

There are, however, potential advantages to the use of an all fluoride bath if it is possible to use the Hall-Heroult system and yet continue to deposit metal. The all fluoride bath potentially: (1) avoids substantial structural changes in the cell if the aluminum oxide can be directly reacted thereby making unnecessary the requirement of the chloride system to close the top of the cell and (2) does not evolve any corrosive, noxious gas, merely $CO_2$. To achieve these advantages the all fluoride bath must be used at low temperatures of 700°-800° C. but such is not possible in accordance with prior art techniques because alumina, unlike aluminum chloride, will not readily dissolve at such low temperatures.

In the comparison of the commonly used Hall-Heroult alumina-fluoride process and the much less familiar aluminum chloride process, there appear to be significant benefits in the use of the aluminum chloride process, but a fair comparison should not overlook the significant disadvantage of the aluminum chloride electrolytic process in producing large quantities of the corrosive gas chlorine liberated at the anode. The chlorine entrains the chloride electrolyte to clog the exit ports and deplete the bath. This entrained electrolyte must be collected and returned to the cell and the liberated chlorine must be recycled to produce further aluminum chloride.

Although the potential advantages of utilizing an aluminum chloride electrolysis process for the electrolytic production of aluminum have been recognized for well over a century, commercial realization of such a process has not occurred.

In general, the usual process known to the prior art for producing aluminum chloride has been the conversion of an alumina-containing material with chlorine in the presence of carbon to yield aluminum chloride and a mixture of the gases carbon dioxide and carbon monoxide. This reaction $$(Al_2O_3+C+Cl_2 \rightarrow AlCl_3+CO_2 \text{ and } CO)$$

has been carried out under a wide range of conditions, each variation having some alleged advantage. All of these procedures for producing aluminum chloride have a common thread however. Each involves the use of a source of carbon, a source of chlorine, and an aluminum chloride reactor separate from the electrolytic cell in which the metallic aluminum is electrolytically produced.

The normal reaction temperature for the production of aluminum chloride is generally in the range of 400° C. to 1000° C. depending upon the form of the reacting agents. Unless a high purity alumina source is used, other elements that are generally present such as iron, silicon, and titanium, are also chlorinated and must undergo difficult separation from the aluminum chloride. This contributes to the size and cost of the aluminum chloride producing plants.

The aluminum chloride electrolytic process would have an unusual advantage beyond those advantages heretofore cited if it were possible to avoid both the chlorine collection and the independent production of aluminum chloride in a plant separate from the electrolysis plant.

The electrodeposition of aluminum by the direct reduction of alumina in an all fluoride bath is an attractive alternative to the aluminum chloride system provided that the alumina would dissolve at the low temperatures of 700°-800° C. rather than the 950°-1000° C. considered to be required for dissolution. Existing Hall-Heroult cells could be used without substantial capital expenditures and great energy savings would be possible with such an all fluoride bath but no such process for the electrodeposition of aluminum is available to those skilled in the art.

The fourth disadvantage of the Hall-Heroult cell, cell power efficiency, has been considered by those skilled in the art but it appears that the practical limit to energy savings and efficiency in present Hall-Heroult cells has been reached through careful design and operation of 150 to 225 Kamp cells at anode current densities between 4.5 and 5.5 amps/in$^2$. The lower energy limit appears to be about 5.6 to 6.0 Kwh/lb utilizing the most advanced designs, computer controls, bath modification and other improvements.

A serious penalty from decreasing the anode current density in the high amperage cells is that less aluminum is produced per unit size although it is at lower energy. This results in a higher capital cost per ton of capacity and a slower return on investment, even though lower fixed cost of operation is achieved. Thus, the greater energy efficiency no longer offsets the increased capital.

As the cell size has increased from about 60 to 100 K amp to beyond about 225 K amp severe problems adversely affecting voltage stability, current efficiency, and cell lining life occur because of the large electromagnetic effects and heat dissipation problems.

Because of the above factors, further increases in energy efficiency of Hall-Heroult cells comparable to those attained in the past should not be expected without radical changes in cell design and chemistry of the basic reaction. Due to the large capital investment in existing cells there is disincentive to make any radical changes that cannot be readily accomplished within the existing cells. Examination within these criteria reveals that the area which will yield the greatest benefits for energy reduction is to reduce the substantial IR loss in the electrolyte between the anode and cathode. Currently, this spacing is about 1.75 inches and accounts for about 50% of the overall ohmic losses. Reducing this spacing from 1.75 inches to 0.75 to 0.5 inch spacing range could reduce overall energy consumption in the range of 20% to 25%. However, with close spacing, the large magnetic field effects inherently present produce undulations at the surfaces of the cathode aluminum pool, resulting in intermittent contact with the anode and short circuiting. It is possible to utilize a drained cathode made from titanium diboride ($TiB_2$) because of its wettability. This concept utilizes $TiB_2$ in various configurations to achieve a narrow spacing between the anode and cathode, and the reduced aluminum wets the $TiB_2$ draining off into a pool. The subject of drained cathodes has received renewed interest due to its potential energy savings as shown by the following patents and publications:

British Pat. Nos. 784,695; 784,696; 802,471; 802,905;
U.S. Pat. Nos. 3,028,324; 3,400,061; 4,071,420;
C. E. Ransley, "The Application of Refractory Carbides and Borides to Aluminum Reduction Cells". The Extractive Metallurgy of Aluminum (Vol. 2, 1963) at 487-507;
R. A. Alliegro, "Boride and Boride-Steel Cathode Leads", Ibid. at 517-524;
D. J. McPherson, "Changing Aluminum for the Nineties", J. Metals (August 1978) at 19-20.

Such approaches will reduce energy consumption in Hall-Heroult cells. However, there are two major disadvantages to such approaches. First, precision $TiB_2$ shapes are required which are expensive and, second, in large cells the bottom will move due to expansion and contraction, which in conjunction with salt and aluminum absorption will result in a spacing change between the anode and cathode along the length of a cell and in some cases within the dimensions of a single anode. Such spacing changes cannot be tolerated within the limits of the 0.75-0.5 inch spacing. Such irregularities will cause some anodes to dissolve much faster than others and cause localized current concentrations resulting in unstable conditions in cell operation particularly with respect to temperature conditions.

SUMMARY OF THE INVENTION

The electrolytic production of aluminum in a single cell from a molten halide salt bath containing $AlCl_3$ that is reproduced in situ on the anode within the electrolytic cell. The $AlCl_3$ is produced at the anode by the reaction of an aluminous source and a reducing agent forming the anode with recycling chlorine produced at the anode during the electrolysis. The $AlCl_3$ produced at the anode upon electrolysis is ionized in the molten bath and is deposited as aluminum metal at the cathode and chlorine at the anode. A unique porous membrane passes electrolyte or other dissolved material while withholding undissolved impurities.

Aluminum also may be deposited by the direct electrolytic reduction of a dissociated and/or dissolved aluminum oxide to produce molten metal at a temperature as low as 670°-810° C. with the use of an all fluoride containing bath and an anode containing aluminum oxide and reducing agent.

The greatly increased electrical resistance of the mixture of aluminum oxide and the reducing agent is minimized by passing the anodic current through one or more conductors of low electrical resistivity which extend through the mixture to, or approximately to, the active reaction face of the mixture in the electrolyte. The position of the ends of said conductors is maintained relative to the reaction face as the mixture is consumed in the electrolysis. These arrangements provide a minimal length of current path through the high resistant mixture and thus result in a low voltage drop of the anodic current in its passage to the reaction face.

A bipolar electrode arrangement may be employed with the mixture of aluminum oxide and reducing agent covering one face of the electrode with the opposite face of the electrode providing a cathode surface.

Cells for the electrodeposition of aluminum may have a reduced anode-cathode spacing of less than approximately 0.5 inch and use pieces of $TiB_2$ extending above the level of the molten metal or may use a heavy salt containing electrolyte that floats the molten metal and is positioned above chunks of anode material at the bottom of the cell. Combined winning and refining cells may have one or two separate compartments and use the porous membrane forming a compact design for efficient electrodeposition of aluminum.

THE DRAWINGS

Figure 4:
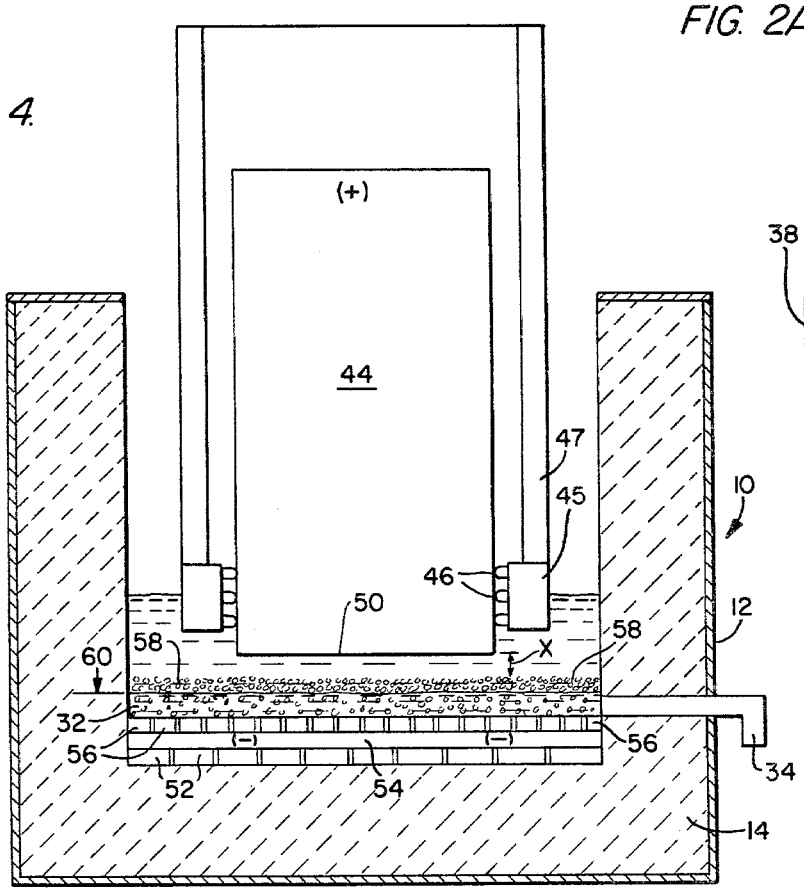

FIG. 4 is a schematic illustration of the all fluoride bath of the present invention wherein an open top electrolytic cell contains an electrode forming a cathode upon which pieces of $TiB_2$ are positioned and prevent the metal that is deposited into the molten metal below from causing a short circuit. A clamp is shown to provide a source of electric current which is secured to the continuously introduced anode.

Figure 5:
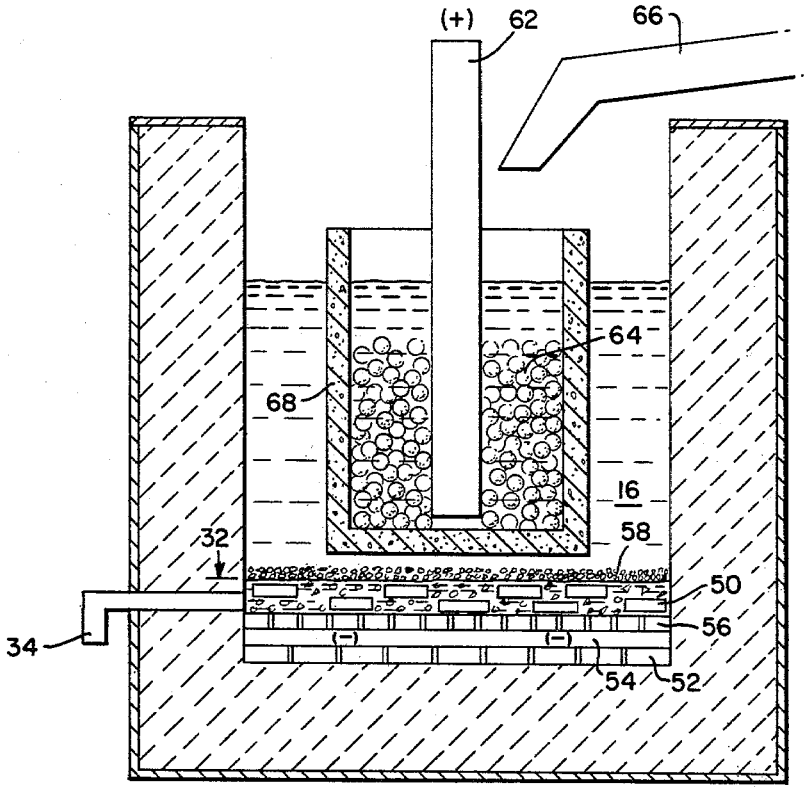

FIG. 5 is a schematic view of an embodiment of the present invention which illustrates the use of a porous membrane to contain the various anodic materials including an aluminum containing material and a reducing agent and also illustrates a modified arrangement of the $TiB_2$ pieces.

Figure 6:
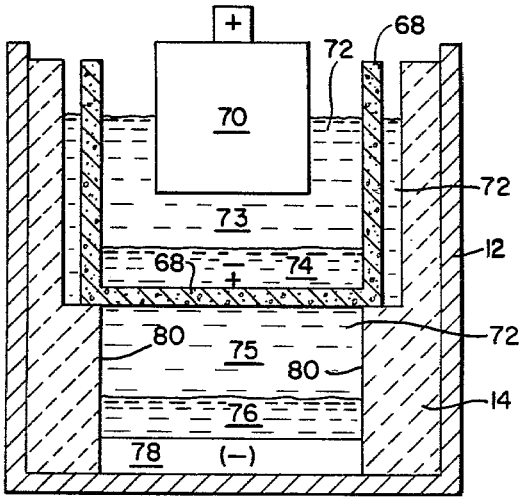

FIG. 6 is a schematic view of another alternate embodiment of the present invention illustrating the use of a membrane to form a single compartment for the simultaneous electrowinning and electrorefining of aluminum.

Figure 7:
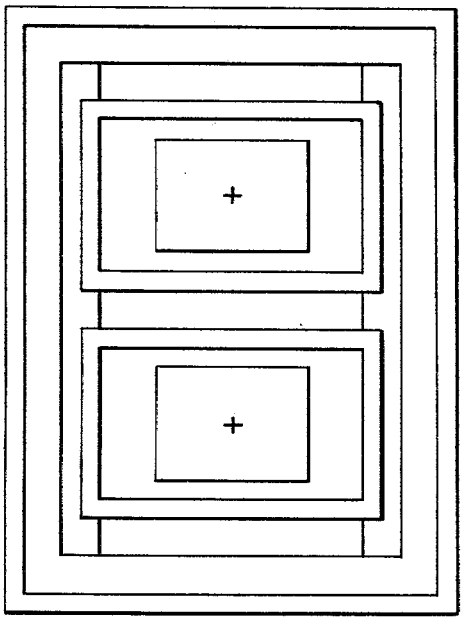

FIG. 7 is a plan view of the embodiment of FIG. 6.

Figure 8:
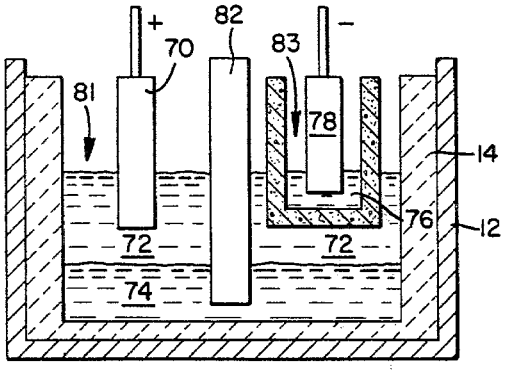

FIG. 8 is a schematic view of a modified combined winning and refining cell in which the density of the salt bath is less than that of the molten metal.

Figure 9:
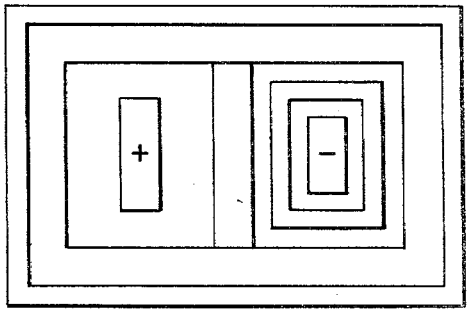

FIG. 9 is a plan view of the embodiment of FIG. 8.

Figure 10:
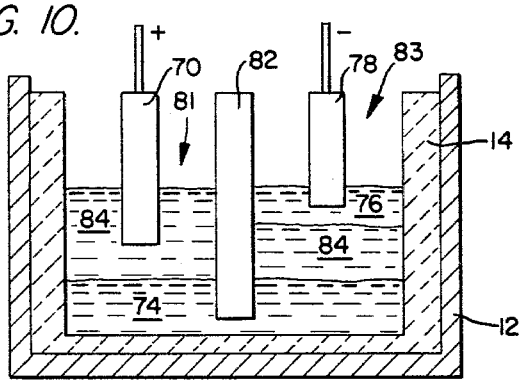

FIG. 10 is a schematic view of a modified combined winning and refining cell in which the density of the salt bath is greater than that of the molten metal.

Figure 11:
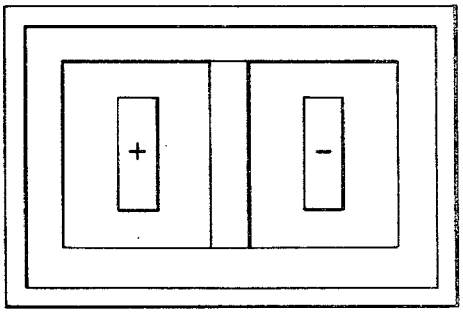

FIG. 11 is a plan view of the embodiment of FIG. 10.

Figure 12:
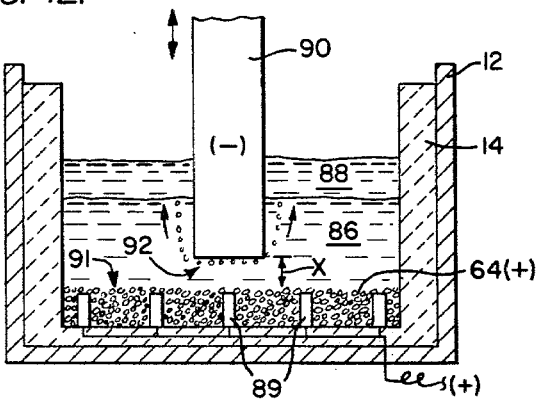

FIG. 12 is a schematic view of a further embodiment of the present invention utilizing a heavy salt electrolyte.

Figure 13:
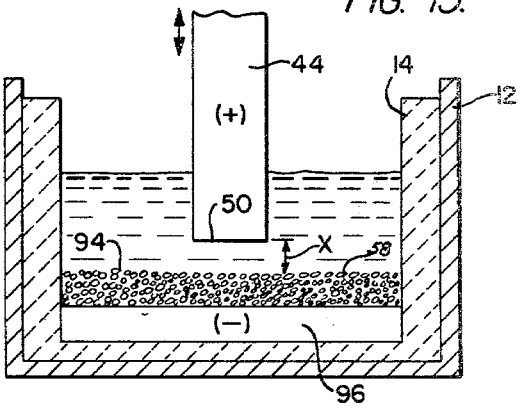

FIG. 13 is also a schematic view of a further modified embodiment of the present invention illustrating the floating particle layer of $TiB_2$.

DETAILED DESCRIPTION OF THE INVENTION

The Process a. Chloride Containing Bath

Figure 1:
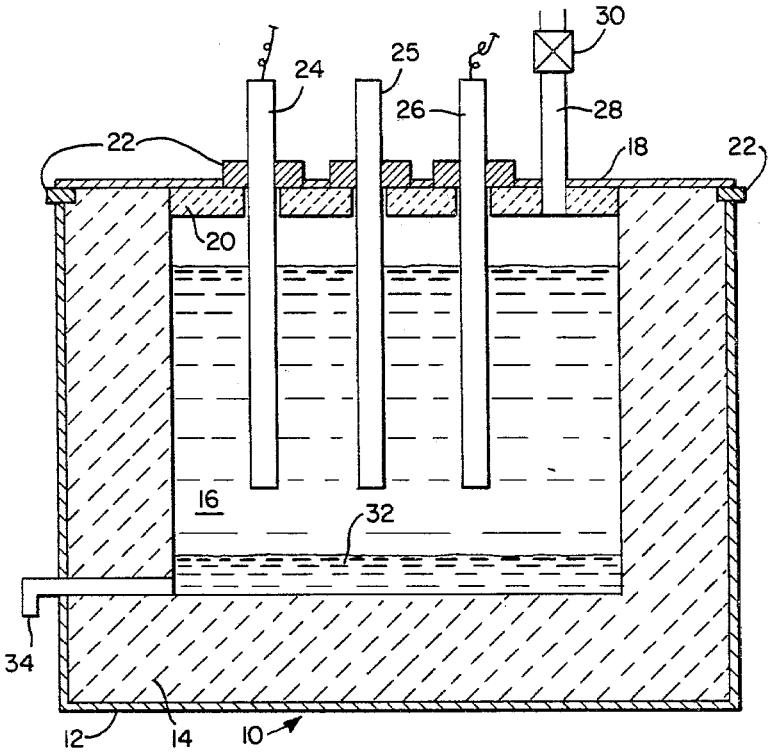
FIG. 1 is a schematic showing of the electrolytic cell of the present invention containing a chloride bath and illustrating the closed top of the cell along with the relative positioning of the electrodes.

The electrolytic process of the present invention for the unique continuous production of aluminum chloride at the anode utilizes the closed top electrolytic cell depicted in FIG. 1 or any of the other cells disclosed herein, if the top is closed or adequate provision is made to prevent: (a) moisture from contacting the chloride electrolyte, or (b) oxidation of the aluminum chloride, while containing the vaporized bath salts. The benefits of the present invention in using the chloride containing bath are derived not only from the continuous in situ production of aluminum chloride at the anode but also from the use of a substantially lower energy requirement to produce a high quality aluminum with the total absence of chlorine gas exiting from the cell.

The continuous production of aluminum chloride at the anode is brought about through the formation of the anode from an aluminous material containing aluminum oxide and a reducing agent. This anode is immersed in a molten bath containing alkali metal and/or alkaline earth metal halide salts of any composition provided that aluminum chloride is present in the bath. Upon electrolysis, ionized aluminum chloride in the bath is deposited as aluminum on the cathode and chloride anions produced at the anode reaction to reform aluminum chloride. The aluminum is collected as molten aluminum and drawn off but it is the chlorine reaction at the anode to form aluminum chloride that constitutes an important part of the present invention.

The halogen chlorine, whether it is the chlorine ion, atomic chlorine or chlorine gas, is believed to take part in the chlorine reaction with the aluminum oxide of the aluminous material and the reducing agent of the anode to produce aluminum chloride plus the reducing agent oxide. The produced aluminum chloride is in turn ionized in the molten bath for continuation of the cycle to produce more chlorine for reaction with the source of aluminum.

The aluminum produced at the cathode generally is as pure as the aluminous material forming the anode. It is possible to produce ultrapure aluminum in accordance with the present invention by utilizing a very pure alumina source or to produce a slightly impure aluminum by the direct use of aluminous ore materials such as bauxite or aluminum bearing clays such as kaolin or mixtures of these ores. In general it is possible to obtain purity of aluminum of at least 99.5%. As will be apparent subsequently, electrowinning and electrorefining are possible in the same cell.

It is known in the Hall-Heroult cell reaction that the carbon of the anode contributes to the overall reaction of winning aluminum by decreasing the decomposition voltage. For example the decomposition of $Al_2O_3$ in cryolite on a platinum anode is about 2.2 volts but on a carbon electrode considering about 50Vol% CO produced and 50% $CO_2$, the decomposition voltage is about 1.2. Approximately, the same decomposition voltage is obtained if methane is injected under platinum to produce mainly $CO_2$.

In the instant invention, the use of the composite anode results in a lower decomposition voltage than would be obtained if $AlCl_3$ were decomposed with the discharge of $Cl_2$ gas on the anode. In any electrochemical reaction, if the current voltage curve is extrapolated to 0 current, a number approximating the decomposition voltage is obtained. In an aluminum chloride electrolysis process when a graphite anode is used, a decomposition voltage of 1.8 to 2.0 V can be obtained which is consistent with values reported in the literature and the theoretical value calculated from thermodynamics. Not in accordance with the prior art, however, is the fact that the decomposition voltage of $AlCl_3$ was reduced when using an anode of $Al_2O_3$ containing aluminous material with a reducing agent.

It was found that the decomposition voltage varies slightly with electrolyte composition. With pure $NaAlCl_4$ the decomposition voltage is the lowest but as the $AlCl_3$ component of the electrolyte decreased, the decomposition voltage tended to increase slightly. The lowest decomposition voltage obtained was 0.5 volts and the highest 1.5 volts. The average value was 1.2 volts. Utilizing the most prevalent average value of 1.2 decomposition voltage, it can be observed that the anode reaction for the in situ formation of $AlCl_3$ from an aluminous anode material reduced the decomposition voltage of $AlCl_3$ by 0.6 to 0.8 V over that obtained when free chlorine is discharge on the anode. This results in a considerable energy saving for the electrolytic production of aluminum over classical chloride systems where chlorine is discharged at the anode as well as saving the additional energy necessary to react $Al_2O_3$, carbon and chlorine to produce $AlCl_3$.

The process conditions for the electrolytic production of aluminum have not been found to be critical with respect to the voltage applied or the current density. The temperature of the bath may vary considerably and is simply that necessary to maintain the bath molten which, depending upon the composition of the halide salts present may be achieved within the temperature range of 150° to 1000° C. but generally may be in the range of between the melting point of aluminum and the boiling point of the cell components, preferably 10° to 400° C. and most preferably 10° to 150° C. up to less than 250° C. above the melting point of the aluminum. The pressure conditions within the enclosed cell are not critical particularly inasmuch as there is no chlorine gas escaping as in prior art processes. While CO or $CO_2$ or both may be generated from the present process, these gases are not as corrosive as chlorine. The pressure conditions, not being important, may range from atmospheric to 10 or more psig.

b. All Fluoride Containing Bath

The Hall cell operates chemically based upon the fact that alumina will dissolve in the cryolite-fluoride salt bath at a temperature of 950°-1000° C. Bayer alumina is soluble in the cryolite containing bath at a minimum temperature of at least 900° C. or above. Any fluoride containing bath at a temperature below about 900° C. will not readily solubilize ordinary processed Bayer alumina and, therefore, alumina, as the source of aluminum, cannot enter the reduction reaction nor is it possible for aluminum to be deposited at the cathode. Without this general solubility of alumina in the fluoride salt bath, it is not feasible to electrowin aluminum. It is for this reason that all commercial cryolite-fluoride cells operate generally in the temperature range of about 960° C.

It has been discovered, as one aspect of the present invention, that in all fluoride containing baths the temperatures may be in the range of between the melting point of aluminum and the boiling point of the cell components, preferably 10°-400° C. and most preferably 10° to 150° C. up to less than 250° C. above the melting point of the aluminum. To electowin aluminum from its corresponding oxide or other oxygen containing compound the range of bath temperatures generally would be about 700°-800° C. and preferably 700°-750° C.

The important aspect of this discovery which differentiates it from the conventional procedures of the Hall-Heroult cell is that the composite anode containing the mixture of aluminum oxide and reducing agent effects a transformation of the aluminum oxide and produces ionic aluminum in the low temperture fluoride bath. The overall reaction, however, is believed to be essentially the same as the Hall cell reaction as previously stated. The aluminum is produced in liquid form on the liquid metal pool serving as the cathode. It is presumed that a reaction occurs at the anode surface in a unique manner that results in the reaction of aluminum oxide similar to the mechanism that occurs in the Hall cell even though the temperature is only slightly above the melting point of aluminum.

The importance of utilizing the composite anode in the present invention should be quite clear because under the same conditions as that of the present invention but using a graphite anode, the addition of aluminum oxide to the bath will not result in either the dissolution of the aluminum oxide or the electrodeposition of the aluminum. A notable feature of the present invention is that, utilizing the composite anode in a low temperature from 670°-810° with an all fluoride electrolytic bath, the Hall cell can be operated in a manner such as FIG. 4 without the closed top required in the operation of the chloride bath as shown in FIG. 1. The bath composition, current densities and other process parameters are not critical to the operation of the chloride bath or fluoride bath containing cell.

c. Heavy Electrolyte Bath

An optional variation to the operational mode of the present invention is the use of a heavy salt composition in the bath. The heavy salt is designed to have a specific gravity greater than that of the molten metal such as aluminum. The heavy salts may be selected from the barium halide salts particularly fluoride and chloride in an amount between 5% and 95% by weight and particularly 30% to 60%. The remainder of the bath may contain any of the bath constituents previously mentioned or known to be compatible in such baths.

The anode material containing for instance the alumina and reducing agent of the present invention may be introduced into the bottom of the cell and if sufficiently dense, i.e., more dense than the electrolyte bath, the anode material in chunks and pieces of whatever shape would remain in the bottom of the cell as shown for instance in FIG. 12. In order to produce anode material sufficiently dense that it sinks to the bottom of an otherwise heavier electrolyte, it may be necessary to fabricate the anode chunks by extrusion or other physical compressive force unless the anode material has inherently a greater bulk density than the electrolyte. If, however, the density of the composite anode material is less than that of the heavier electrolyte, such anode material can be retained on the cell bottom by means of an appropriate grate or membrane (not shown). Such a mechanical restraint can assist in obtaining a good electrical contact to the composite anode pieces on the cell bottom.

The principal advantage of the use of the heavy salt to form the electrolyte lies in the close spacing possible between the cathode and the anode layer. Close spacing is possible due to the liquid aluminum layer being relatively far from the layer of anode material while the cathode penetrating through the liquid aluminum, can be very close to the anode layer without encountering magnetic flux disturbances that previously prevented such close spacing between the cathode and anode in large commercial cells. An additional advantage has been found to be the relative ease of spacing control when utilizing a dimensionally stable cathode as the movable body as opposed to the consumable anode.

To operate a cell utilizing a heavier salt, consideration must be given to the by product reaction gases $CO_2$ and CO that must pass up through the cell and the aluminum layer. Reaction of the off gas and metal may be reduced by channeling the gas such that it has minimal contact with the metal. However, at the lower cell temperature of about 700° C., the reaction rate between $CO_2$ and aluminum is substantially reduced.

The Anode

The anode provides the source of aluminum ions for reduction to aluminum at the cathode as well as the means to conduct electrical current through the dielectric aluminum oxide to the reaction site for the aluminum oxide. The anode also preferably provides at least in part a necessary source of a reducing agent that enables the aluminum oxide to react to lead to the production of aluminum metal. The reducing agent is preferably at least in part intermixed with the aluminum oxide but also may be in gaseous form to, in either of these embodiments, provide intimate contact between the reducing agent and the aluminum oxide. The reducing agent, if properly selected, to be conductive may when intermixed with the aluminum oxide also fullfill the function of a conductor of electrical current to the reaction site. If the reducing agent is not intermixed with the aluminum oxide, the electrical conductor function must be otherwise achieved to maintain the aluminum oxide anodic at the reaction site.

In the chlorine cycle the anode has the additional function to provide a reducing agent that aids in the reaction of the aluminous source with the chlorine, either in ionized form or molecular form to produce continuously the aluminum chloride which is electrolyzed into aluminum and chlorine. This in situ production of aluminum chloride at or near the surface of the anode is an important part of the chloride cycle of the present invention because it eliminates the necessity for any external replenishment of the aluminum chloride being electrolyzed.

In the all fluoride cycle process, the anode of this invention provides the aluminum oxide that reacts in the fluoride bath at a uniquely low temperature in the 670°–810° C. range. The cell may also be open as in FIG. 4 or 13.

The source of the aluminum is alumina, $Al_2O_3$, but also it could be any aluminum oxide bearing material such as bauxite or a clay such as kaolin or other material which would react at the anode to produce aluminum chloride or be reduced to the molten metal as in the fluoride cycle process.

When the intermixture forms the anode, the proportion is in an amount that ranges from 1.5 to 7.5 up to 20.0 to 50.0 or more parts by weight of aluminum oxide in the aluminous material per part of the weight of the reducing agent. Preferably, for the purposes of the present invention, the amount of aluminum oxide in the aluminous material intermixture may be 2.0 to 6.5 and most preferably 2.5–6.0 parts by weight aluminum oxide per part reducing agent.

The reducing agent that may be used in accordance with the present invention is not limited to any particular material, but could be any of those materials known to be effective to react with the aluminum oxide. In the case of aluminum in the chloride bath cycle, the reaction is to aluminum chloride from a source of aluminum oxide. The reaction in the fluoride bath is not clearly defined but it may be that the reducing agent reacts with the $Al_2O_3$ to produce aluminum ions.

Among the reducing agents that are particularly useful for alumina and other oxides are carbon used in the intermixture and a carbon containing reducing gas carbon monoxide. Carbon is particularly preferred because it characteristically has the dual capability of carrying current to the reaction site of the aluminum oxide as well as maintaining a reducing function.

The source of carbon in the intermixutre can be any organic material particularly those having a fossil origin such as tar, pitch, coal and coal products, reducing gases, for example carbon monoxide, and may also include natural and synthetic resinous materials such as the waxes, gums, phenolics, epoxies, vinyls, etc. and the like which may be coked as desired while in the presence of the aluminous material. Coking of the carbon source intermixed with the aluminum oxide compound can be accomplished by known art techniques such as those used in prebaked anodes that are utilized in the Hall-Heroult cell. This is accomplished by casting, molding, extruding, etc., a composite anode such as $Al_2O_3$-pitch in the desired ratio of, for example 2.8 parts aluminum oxide to one part carbon in the coked condition, and slowly heating the formed anode in a nonoxidizing atmosphere to a coking temperature of 700° to 1200° C. After coking, the composite anode is then ready for use.

It is also, for instance, contemplated within the scope of the present invention to produce carbon as a reducing agent in the intermixture with aluminum oxide by coking the carbon source in the molten electrolytic bath both prior to and during electrolysis. Bath temperatures typically in the range of 700° to 850° C. are adequate to coke the carbon source to produce the carbon necessary. The time to achieve such coking is not critical but it may require several minutes to several hours depending upon the temperature of the molten bath and the mass of the mixture of aluminous source and the reducing carbon source.

The entire source of the reducing agent, as previously stated, optionally need not be intermixed with the aluminum oxide source to form the anode. It has been found, for instance, that the only requirements for the reducing agent are that it be in contact with the anodic aluminum oxide and present in sufficient amounts to produce aluminum metal at the cathode. It is manifest however that electric current must be transmitted to the reaction site to enable the reaction to proceed.

The reducing agent may thus in part be a reducing gas such as carbon monoxide which comes in contact with the anodic aluminum oxide to enable the reaction producing aluminum ions to take place. The anode can then have substantially less intermixed carbon reducing agent, if any. In its broadest aspects the proportion of the intermixture of aluminum oxide to reducing agent is, as previously stated, at least 1.5 parts to 1 part without any actual upper limit of aluminum oxide. Should substantially all of the reducing agent be in the form of the carbon monoxide the appropriate ratio of aluminum oxide to reducing agent is 0.5 parts $Al_2O_3$ to 1 part CO more preferably at least 1.2 to 1 without any upper limit to the amount of $Al_2O_3$.

If carbon is not intermixed to carry the current, it is conceivable that another conductor, compatible with the cell and its contents, could be used. For instance, combinations of noble metals and high melting conductive oxides such as silver-tin oxide or $TiB_2$, alone or composites with carbon or graphite may be intermixed with the aluminum oxide in amounts merely sufficient to carry electric current to the reaction site. Such amount is not critical provided the aluminum oxide is made anodic at that reaction site. Amounts as low as about 0.001 up to at least about 0.75 parts conductive material per part aluminum oxide may be used. Greater amounts increase the conductivity at the expense of the availability of the reactive material but are possible without any actual upper limit.

The reducing gas can be bubbled to the surface of the anodic aluminum oxide from within the bath by a tube positioned below the anode in any suitable manner, or it is possible that the anode can be perforated on the sides and/or bottom and the reducing gas passed down the anode or central core and out through the perforations. In this manner, the reducing gas would always be in contact with the aluminum oxide component of the anode permitting the reaction producing aluminum ions to occur.

In the case of alumina as the aluminous material, the use of hydrated or calcined alumina may be used. Anodes formed from hydrated alumina have improved conductivity compared to calcined alumina but hydrated alumina, $Al_2O_3 \times 3H_2O$ or Al $(OH)_3$ has the tendency to crack during prebaked type coking and when placed in the hot bath, due to the water driven off during the coking operation. In a chloride cycle utilizing in bath coking of the hydrated alumina, the water driven off could undesirably hydrolyze the $AlCl_3$.

Any cracking or breaking of the anode due to the expelled moisture causes no difficulty provided the membrane as shown in FIG. 5 surrounds the anode. Any particles of the anode that drop off will be contained in the membrane for continual reaction. The anode may also be any proportion of hydrated and calcined oxide to minimize the cracking. The maximum amount of hydrated oxide that can be used affects an energy saving in calcining.

The size and surface area of the particles making up the anode containing the aluminum oxide have not shown any sensitivity regarding reaction rate. This characteristic of the present invention is in contrast to prior art experience in the reaction of $Al_2O_3$ and carbon with chlorine as a gas-solid reaction in a furnace. In the past it has been found that the reaction temperature and rate are highly sensitive to the particle size and particle surface areas.

It is generally desired in the prior art to utilize alumina with a surface area in the range of 10 to 125 $m^2/g$ in the $AlCl_3$ reaction. However, in the present invention, no sensitivity was detected with regard to reaction rate of the anode based upon particle size or surface area. That is, $Al_2O_3$ with a surface area of 0.5 $m^2/g$ or less apparently reacted as readily as $Al_2O_3$ with a surface area of 100 $m^2/g$. These results are based upon experiments run with anodes containing alumina having particles with differing surface area and sizes. Anode current densities ranging from 2 to 40 amps/$in^2$ were run in cells with the exhaust line connected to a starch-iodine indicator for chlorine detection. No chlorine gas was detected regardless of the current density or the surface area of the alumina. This suggests that all chlorine produced at the anode reacts to reform aluminum chloride.

Figure 2:
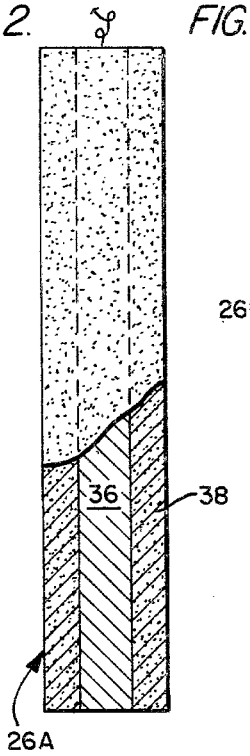
FIG. 2 is a schematic showing of one of the electrodes of FIG. 1 being used as an anode and having coated thereon the mixture of aluminous material and reducing agent.

Anodes for use in electrolysis cells may be produced in a variety of forms and by a variety of fabrication processes. A mixture of aluminum oxide material and the reducing agent may form the anode in any convenient manner. For instance, a mixture may be bonded to a typical electrode to form a coating surrounding all or one side of the electrode as shown in FIG. 2 of the drawings. It is also contemplated that the anode material may form the anode by being molded or formed into a suitable shape to which is attached one end of the electrode rod or pin in the manner shown in FIG. 3 of the drawings. It is also possible to meet the requirements of the present invention to form the anode in the manner other than having any physical bonding directly to the electrode. It is desirable, however, that the aluminous material be in intimate physical contact with the carbonaceous material or other reducer. The latter concept may be brought into being if the mixtures of the aluminous material and reducer are in the form of a homogeneous mixture of powders, small pellets of the mixed powders, or larger composite briquettes of such mixed materials that may have been formed by molding or extrusion into various sizes from 0.001 inch to 1 inch or more. Uniformity of the distribution of the carbon and aluminum oxide has been found to be desirable to attain maximum anode efficiency during its dissolution or reaction under electrolysis.

To hold the aluminous material and the reducing agent forming the anodic materials in the region of the electrode and thus in combination forming the anode, a container in the form of a porous membrane may be utilized. As was previously described this membrane can be used to retain pieces of the anode that may be broken off due to the evolution of moisture from the anode and thus retain the conductivity of the anodic material.

Figure 3:
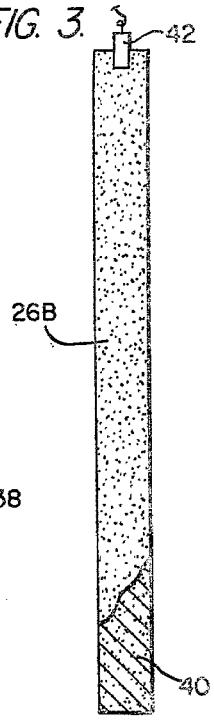
FIG. 3 is a schematic drawing of an alternative electrode for use in the electrolytic cell of FIG. 1 in which the electrode used as an anode has a composition, substantially and entirely of the mixture of aluminous material and reducing agent.

For successful commercial use, the anode should be as conductive as possible. Since the anode of the present invention is not solid or pure carbon as is traditionally used in the Hall cell, it will be less conductive because of the presence of the aluminous compound. If the anode were permitted to become as resistive as the salt electrolyte then the heat balance can be affected due to overheating that can occur as a result of passing the same current through the more resistive anode. For instance, when using a solid composite anode such as shown in FIG. 3 in the cell of FIG. 1, it is necessary for the electric current to travel through the anode from top to bottom, with power losses translated to heating of the bath. It is therefore desirable to construct an anode to have as high a conductivity as possible. Obviously, the more conductive the anode material, the lower the power consumption for winning metal but in any event the conductivity of the anode should be greater than the conductivity of the salt for optimum operation. Particularly when it is desired to achieve the goal of maximum production of aluminum with minimum power usage, the resistance of the anode becomes significant.

It has been found that the conductivity of the anode varies considerably depending on the manufacturing process. The parameters which have been found to affect conductivity are the ratio of binder carbon material such as pitch, carbon or coke particles included in the composite anode as the source of the reducing agent and the type of aluminum oxide. The greater the carbon content of the anode, within the previously specified ratio of aluminum oxide to reducing agent, the greater the conductivity. It is possible, for example, when using a ratio in the range of 4/1 to 6/1 aluminum oxide to carbon to construct a solid composite anode that has at least a tenth the conductivity of a standard Hall-Heroult anode.

Figure 2A:
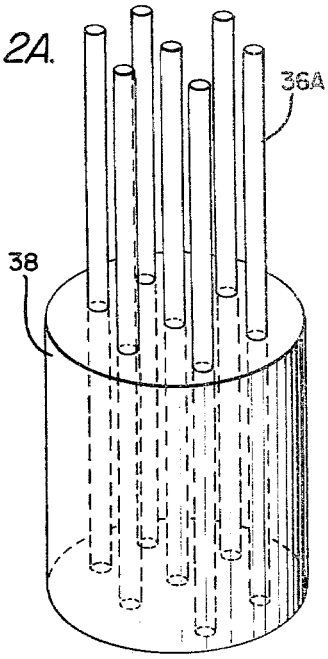
FIG. 2A is a schematic view in perspective of an alternate embodiment of the electrode of FIG. 2 showing a plurality of conductor cores within a matrix of the aluminous material and reducing agent.

In order to reduce the power loss through the composite anode, several alternatives are also shown in FIGS. 2, 2A and 4. In one embodiment for smaller sized anodes, a power attachment clamp near the bottom of the anode, as in FIG. 4 rather than at the top as shown in FIGS. 1 and 3 could be utilized. Such can be accomplished utilizing a split cylinder or similar device as shown in FIG. 4. The attachment clamp may be made from any material that is a good conductor and is compatible with the salt environment. Typical materials are carbon, graphite, $TiB_2$ and composites of these materials. The split cylinder may be smooth or have nubs to provide good contact with the anode material. The point of attachment may be essentially at the end of the anode or at any desirable point above the end such as above the salt level. The closer the attachment clamp to the end of the anode, the less power loss due to resistance in the anode. If the attachment clamp is in the salt, the attachment clam material does not act as an anode since the composite anode will preferentially dissolve and the attachment clamp will not be anodically dissolved.

Using the attachment clamp as shown in FIG. 4 allows solid composite anodes to be continuously fed into the cell. This is accomplished simply by introducing one anode on top of the last and as consumption occurs the anode is continuously lowered until one is completely consumed and the next takes its place, and so on. Similarly, the anode need not be prebaked and could be fed continuously to the cell in the green state as in the case of a traditional Soderberg electrode. In this case, steel pins are traditionally used to make contact but the contacts could also be graphite, carbon, $TiB_2$, aluminum or composites of these. The green composite anode material is gradually coked from the heat of the cell such that the end of the anode in the salt is always fully coked to the operating temperature of the cell. It should be understood that coking in the Soderberg fashion in the cell does not produce as high a conductivity anode as can be achieved with prebaked composite anodes. The cell operation is generally conducted in the 670°-810° C. range which becomes the coking temperature whereas prebaking can utilize much higher coking temperatures and thus achieve higher anode conductivity.

To achieve higher conductivity and reduce power loss through the composite prebaked anode another embodiment utilizes a conductive core in the anode as shown in FIGS. 2 and 2A or a plurality of vertically arranged conductor pins as shown in FIG. 4B.

The conductive central core 36 in FIG. 2 can be carbon or graphite molded into the anode 26A or the composite anode material composition 38 molded or coated into a preformed conductive core shape. The central core 36 may also be a metal such as the same metal being deposited, for example, aluminum.

For large size anodes another alternate embodiment is shown in FIG. 2A. To improve conductivity, primary grade purity aluminum rods 36A are used as electrical conduction buses through the anode composition 38. Since primary grade aluminum is used as the conductor rods, it will melt as the anode is consumed and join the cathode metal without harm, and can be recycled. The rods are spaced such that the voltage drop is minimized relative to the conductivity of the composite anode.

To achieve desirable conductivity in the anode the spacing between the outer surface of the composite anode 38 and the surface of any aluminum rod as in FIG. 2 or 2*a* and mutual spacing between the outer surfaces of the aluminum rods in FIG. 2A is not critical and may range from 0.125 to 24 inches, preferably 1.0 to 6.0 inches and most preferably 1.5 to 4.0 inches. As an example, if the conductivity of the composite anode is approximately 0.1 of a standard prebaked Hall cell anode then aluminum rod spacing of approximately 3.0 inches will result in an acceptable voltage drop.

Since the operating temperature of the cell is usually in the 700°-750° C. range the aluminum rods can be sized such that they will melt approximately at the same rate as the anode is consumed and will thus conduct power to the bottom of the anode. If the diameter of the aluminum rod is too large, it will not melt and salt will freeze over its surface which results in the anode being consumed leaving an aluminum stub that will short to the cathode as the anode is advanced. If the rod diameter is too small it will melt back too far into the anode which results in too large a voltage drop due to the longer conductivity path. It is desirable that the aluminum rods melt back into the anode to a slight degree rather than remaining flush with the bottom surface of the anode. This is so that anodic oxidation of the aluminum rods will be minimized. Desirable melt back distance is based upon that which provides the minimum voltage drop coupled with the minimum anodic oxidation of the aluminum rods. Should the rods remain flush with the bottom surface of the anode, there would be a tendency for aluminum ions to pass into the bath from the rods (as in a refining operation) as well as from the composite anode material, thus lowering the cell's Faradaic efficiency. Heat can be balanced such that the conductance from the bath up through the anode and power generated through the conductors is balanced to achieve the desired amount of melting of the conductor aluminum rods. Depending on the anode current density and the cell operating temperature, the size of the aluminum rods may fall within the diameter range of 0.125 to 3.0 inches preferably 0.25 to 2.0 inches most preferably 0.375 to 1.0 inch.

The Membrane

The membrane as shown in FIG. 5 of the drawings is designed to have a tripartite function or capability.

First, the membrane acts as a separator or quiescent barrier between the molten cathodic metal phase and the source of anode material to be electrolyzed. With the use of the membrane of this invention, the spacing can be reduced substantially to achieve significant increases in conductibility and efficiency without any turbulent effects that could otherwise produce a reduction in the efficiency or quality of the aluminum product.

Second, in the present invention, the membrane physically restrains materials of the composite anode that, for instance, may include the aluminous raw material and the reducing agent. This restraint maintains these materials close to the electrode to form an anode for production of $AlCl_3$ in the most efficient manner. The membrane also prevents mixing of the raw materials with the molten aluminum at the cell bottom. Should a hydrated metal oxide, such as the hydrated alumina, be used as one of the anodic materials, the membrane holds any of the pieces of the anode that may crack off due to the evolution of moisture from the alumina during bath coking. These pieces continue to be a source of aluminum through the reduction reaction as long as they are within the anode circuit within the membrane.

Third, the membrane permits the free passage of ionic substances and dissolved solids in the electrolyte but will not pass and will substantially reject molten aluminum and undissolved solid materials that constitute the usual impurities present in the aluminous source and prevent the contamination of the cathodic deposition.

The external shape of the membrane is not important and may be in the form of a cylinder, prism, etc., or portion thereof. For instance, the membrane may have a three or four-sided shape with a bottom and thus form an enclosed container. This container is so designed to hold the anodic raw materials for reaction in the salt bath.

Due to the corrosive nature of the molten salt bath, the selection of the materials to form the membrane is important to the life of the cell and the success of the process. If the electrolyte to be used is an all chloride bath, the choices for the membrane are somewhat greater due to the reduced corrosive character of such a bath as compared to a bath containing fluorides. Baths containing some fluorides are preferred, however, because of their lower volatility. The all fluoride bath possesses other advantages as set forth above. Materials suitable for use in a fluoride bath would of course be useful in the less corrosive chloride bath.

Among the materials that have been found to be useful include vitreous carbon foam, carbon or graphite as a porous solid or porous solids of refractory hard metals such as: the nitrides of boron, aluminum, silicon (including the oxynitride), titanium, hafnium, zirconium and tantalum; the silicides of molybdenum, tantalum and tungsten; the carbides of hafnium, tantalum, columbium, zirconium, titanium, silicon, boron and tungsten; and the borides of hafnium, tantalum, zirconium, columbium, titanium and silicon. Other refractory hard metals as known in the art may be found useful to form the membrane provided that they are resistant to the molten salt bath.

The refractory hard metals forming the membrane of the present invention may be made into the form of a cloth, mat, felt, foam, porous sintered solid base or a simply a coating on such a base, all of which are known in the art for other purposes. The membrane must also meet particular standards of through passage porosity and connected pore size.

These two characteristics may be defined as follows:

through passage porosity—the percentage of the total volume of the membrane that is made up of passages that pass through from one side of the membrane to the other;

connected pore size—the smallest diameter of a passage through the membrane.

The through passage porosity varies with the nature of the membrane material, the temperature of the molten bath and the salt composition but the common characteristic of useful membranes is that the porosity must be sufficient to pass all the metal ions such as aluminum and all the electrolyte salts without passing the undissolved impurities. It has been found that the greater the porosity, the greater is the current flow and, therefore, the greater the electrical efficiency of the cell. The porosity may vary from 1% to 97% or more, but generally is in the range of 30% to 70%. The preferred porosity to achieve the greatest efficiency is in the 90% to 97% range. A vitreous carbon foam, for instance, is capable of yielding such a high porosity and retain sufficient mechanical strength.

The connected pore size must be small enough to reject the solid impurities that have not been dissolved but large enought to pass the ionic and dissolved particles. Generally, the acceptable pore size is between one micron and one cm.

The thickness of the membrane material is a function of its porosity, pore size and ability to retain undissolved impure solids and molten metal. Obviously the thicker the membrane, the greater the electrical resistance. It is therefore desirable to use as thin a membrane as is practical consistent with the porosity and pore size standards as well as the mechanical strength of the membrane in position in the cell. The preferable thickness is 0.125 to 0.5 inch but may be as thick as 2.0 inches or more.

Typical membrane materials that have been found useful include but are not limited to vitreous carbon foam, carbon or graphite in the form of a porous solid, felt or cloth, aluminum nitride, silicon nitride, silicon carbide, silicon oxynitride, boron nitride and titanium nitride as a porous solid, as a cloth or as a coating on the surface of a vitreous carbon foam or porous graphite. Aluminum nitride appears to be the most desirable material. It has been found that aluminum nitride can conveniently be formed in a porous structure by first making a porous alumina structure then impregnating with carbon followed by heating to 1750° C. in a nitrogen atmosphere to convert the alumina to aluminum nitride. Such a procedure results in a strong porous structure that is chemically compatible with the corrosive salt environment and the molten aluminum.

The Molten Bath Composition

The electrolytic bath of the present invention for producing aluminum chloride can vary considerably in comparison to the typical Hall cell salt composition. In the present invention the bath composition may include any halide salt, particularly, chloride and fluoride are favored. Any alkali or alkaline earth metal such as particularly sodium, potassium, lithium, calcium, magnesium, barium and the like may be used to form the halide salts. There is no critical composition or range of proportions desired or necessary although it is obvious that the bath for use in the chloride cycle process described above must contain some proportion of aluminum chloride and may range from an all chloride bath to a mixture of chlorides and fluorides. Preferably the bath contains 2% to 60% $AlCl_3$ but may also be in the range of 1% to 95% by weight $AlCl_3$. The all fluoride bath may include the same fluoride salts as set forth above in any proportion desired. A heavy salt electrolyte bath generally should contain from 5% to 95% or more of heavy metal salts such as barium salts including the fluorides or chlorides. The remaining salt components may be fluorides or chlorides or mixtures of both of other metals.

Among the advantages and disadvantages of the various electrolyte types are that the all chloride bath has very low tolerance to oxide contamination, but has very high conductivity and is the least corrosive to refractories and cell components. The volatility of the aluminum chloride component is the highest with the all chloride electrolyte and when the aluminum deposits, it tends to do so in small droplets which resist pooling and agglomeration. As the fluoride component is increased in the electrolyte, the vapor pressure of the aluminum chloride component is substantially reduced and the tolerance of the electrolyte to absorb and dissolve oxides is greatly enhanced. In fluoride containing electrolytes the aluminum deposits as droplets which agglomerate and pool readily, but the corrosivity of the electrolyte to refractories and cell components is greatly increased.

A lithium component of any electrolyte will increase the conductivity but is expensive and increases the cost of the electrolyte. This has to be balanced in any operation as to the electrolyte cost, conductivity of the electrolyte and the resultant power consumption of producing the aluminum.

The preferred electrolyte is a balance of economics of the salt components, conductivity, corrosiveness to refractories and cell components, tolerance to oxide contamination and agglomeration of the deposited aluminum into a pool for easy harvesting.

The Cells and Decrease of Cathode-Anode Spacing

In the drawings there are depicted various embodiments of the electrolytic cells capable of producing electrolytically aluminum from aluminum oxides.

In FIG. 1, the closed cell is shown generally at 10 as composed of an outer steel shell having a refractory lining 14. The refractory lining may be of any material resistant to the action of the molten electrolytic bath 16. A refractory material is designed to maintain the desired thermal balance in the cell operation and therefore may be very thin to achieve a small thermal gradient which will result in a thin layer of frozen salt on the surface of the refractory and thus result in a hot outer wall on the surface of the steel shell 12. The refractory lining may also be quick thick to achieve a freeze-out layer of salt within the refractory lining resulting in a cool surface on the steel shell. It is well known in the art that the insulation and cell lining thickness depends on the size of the cell and the amount of heat to be dissipated which is also related to the operating parameters of the cell.

The lid 18 is provided on the top of the cell only for use in an aluminum chloride containing bath relying upon the chlorine reaction. The closed cell also prevents any vapors of the chloride containing salt composition 16 from seeping out to react with the environment. The lid 18 may be lined with the refractory material 20 which may be the same as the refractory lining 14 or any other refractory material consistent with maintaining temperature balance in the cell. The lining should as well be chemically inert to the salt composition 16. Seals 22 are supported on the lid 18 and are secured against the electrodes 24, 25 and 26 to prevent atmospheric air and moisture from seeping into the cell or the vapors from the cell exiting to the environment. The sealing at the lid 18, around the electrodes as well as between the cell body and lid, may be by any means which prevent vapor leaks and may be standard or conventional packing and gasket material capable of withstanding the temperature of the operation and resistant to the halide vapors. Acceptable materials for such packing gasket use include asbestos, fibrous ceramics, Teflon, Vitron, silicones, liquid metal seals such as mercury, liquid solder, tin, lead, etc.

Electrodes 24, 25 and 26 may be anodes, cathodes or bipolar electrodes. They may include solid or coated conductors to carry electric current for the cell operation. These conductors may be any material that may withstand the temperature within the cell which is the range of 150° to 1060° C., stable to the halide composition 16 and are good electrical conductors. Materials that are useful for this purpose are carbon, graphite, and titanium carbides, nitrides or borides and aluminum metal as appropriately sized for heat transfer balance. The preferred materials for these conductors have been found to be graphite and titanium diboride when operating in the bipolar mode.

The aluminum chloride cycle cell also includes a stack or exit tube 28 having a valve 30 to control the flow of any gaseous elements from the stack and establish the pressure buildup in the cell for continuous operation. Gaseous vapors emanating from the cell are those of the reducing agent oxide and notably there is no chlorine gas detected at all. The chlorine that is produced is reacted at the anode 26 and recycled as aluminum chloride. The molten aluminum 32 is tapped out by conventional tap 34 or otherwise drawn out by vacuum through standard siphoning techniques well known in the art.

FIG. 2 discloses at 26A a detailed embodiment of the electrodes 25 and 26 of FIG. 1 when used as anodes. The anode 26A includes a central electrode or conductor 36 that may be any one of the materials previously mentioned. The exterior of the conductor 36 is coated on one side for bipolar use or surrounded on both sides for monopolar use by a matrix 38 of composite anode material comprising the mixture of aluminum oxides and reducing agent as previously described. When coated on a single side a bipolar operation is anticipated. The term "oxides" should be interpreted to include the silicates which often are a combination of the metal oxide and silicon oxide or any other oxygen containing compound of the aluminum to be deposited.

FIG. 2A discloses an embodiment of the composite anode which utilizes several conductors 36A composed of aluminum metal and embedded in a matrix 38 of the composite mixture. The number and size of the conductors 36A are selected based on anode size, current density of the anode, cell size, operating temperature and heat transfer such that the aluminum conductors 36A melt at the same rate that the matrix 38 of the anode is consumed. The unique advantage of the anode embodiment shown in FIG. 2A avoids large voltage drops in the relatively highly resistive anode that permits the process to be operated at substantially reduced power consumption.

FIG. 3 discloses another alternative embodiment of the composition of an anode electrode as shown at 26B. In the embodiment electrode 26B is composed of a composite 40 which may be the same as the coating 38 in FIG. 2 but is formed into a suitable shape for use as an electrode. This form of the electrode may be molded about a stub or pin electrode 42 which extends out from the upper end of the body of the electrode 26B for connection of the usual electrical circuit. Alternatively electrode 26B is molded and then stub 42 is inserted by known art techniques such as utilized with prebaked Hall cell anodes.

In FIG. 4 a modification of the cell design of FIG. 1 is illustrated. This open cell is principally to be used for the conventionally used Hall cell due to the open top. The cell structure, including the shell 12 and refractory 14, are identical to that shown in FIG. 1. The electrode 44 serving as the anode may be either one of the anodes shown in FIGS. 2, 2A or 3, preferably that shown as 26B in FIG. 3. The anode 44 is immersed in the electrolyte containing fluoride salts and heated to a temperature generally between 670° and 810° C.

As can be seen from FIG. 4, a power attachment clamp 45, shown schematically, is in contact with the anode 44 below bath level and adjacent to the bottom of the anode to minimize the power loss due to the resistance of the anode. The clamp 45 may partially or completely surround the anode 44 as it may be fed continuously into the bath. The clamp is composed of any suitable inert material that is electrically conductive. Among these materials are graphite, carbon, $TiB_2$ or mixtures of these. The electrical contact between the clamp and the anode may be through protruding contact point 46 if desired. The power attachment to the clamp 45 is through suitable conductors 47 that extend above the cell top.

The power attachment clamp 45 as shown in FIG. 4 unfortunately possesses certain inherent disadvantages if utilized in large commercial cells wherein an anode of substantial width or diameter would be utilized. If for instance the anode 44 is cylindrical, as the cell size increases so too would the diameter of the anode increase such that the distance for the current to traverse through the anode can produce too long a path with resulting voltage drop that increases the power required to produce aluminum. To overcome this disadvantage several alternatives are possible in accordance with the present invention as have been shown in FIGS. 2 and 2A.

At the bottom of the cells shown in FIGS. 4 and 5 are important optional aspects of the present invention. These cells are each shown to have a cathode to anode spacing of less than 1.0 inch and even less than about 0.5 inch but preferably about 0.25 inch.

The spacing between the base or active surface 50 of the anode and cathode is shown at "x" in FIG. 4. To permit this small a spacing when the usual spacing is more than 1.5 inches in the traditional Hall cell, the construction of the cathode of the present invention is unique. Conductive refractory hard metal pieces are utilized to form the cathode. The composition of these pieces is disclosed in the prior art and in general may be decreased as material that is conductive of electrical current and is compatible with the temperatures, cell components and conditions used in electrolysis. Dimensional stability required in the prior art is not a factor in the selection of the particular composition.

The term "conductive refractory hard metal" in general refers to borides, carbides, nitrides and silicides of the transitional metals in groups IVb, Vb and VIb of the Periodic Table as shown in the Handbook of Chemistry and Physics, 57th Edition, 1976–1977 and/or mixtures thereof with alloys. Preferable in this group are titanium boride, carbide and nitride, zirconium or hafnium boride and mixtures thereof.

The cathode is composed of a layer of bricks 52 of carbon or a steel bar connected to a suitable source of electric current and another layer of bricks 56 similar to those forming the first layer is superposed upon the steel bar.

Selected geometric configurations of the described conductive refractory hard metal pieces 58 are positioned on top of and, optionally as shown in FIG. 5 to economize on the use of these pieces between the bricks. In the embodiments of FIGS. 5 and 13 pieces 58 of $TiB_2$, for example, extend to approximately 0.25 inch of the bottom active surface 50 of the anode. It has been found that with the use of particulate pieces of $TiB_2$ it is not possible to maintain a precise uniform spacing "x" but that an average spacing "x" between the anode and $TiB_2$ pieces of approximately 0.25 inch would be satisfactory.

Results of tests have shown that there is a great energy input reduction due to the reduced spacing. This is easily understood but the important fact is that the molten metal level 60 is prevented from contacting the anode and causing a short circuit by reason of the pieces 58 extending at least about an inch above the quiescent level of the molten metal.

The pieces of $TiB_2$, for example, are preferaby though not necessarily in mutual contact and randomly distributed or preselectively positioned and supported upon, but without being secured or attached to the cathode floor or pad or the bricks previously mentioned. These pieces of $TiB_2$ being so movable are particularly desirable because routine cleaning and maintenance, for example raking the mulk from the bottom of the cell, can be achieved very easily. The $TiB_2$ pieces are preferably superposed to a thickness of substantially at least two $TiB_2$ and preferably three or more pieces to create irregular continuous flow channels between adjacent pieces forming desirably many continuous tortous paths. These flow channels are sufficient in size and extent to permit the aluminum to flow freely through the $TiB_2$ bed to the liquid pool but the primary purpose of establishing these flow channels is to create a tortuous path for the molten aluminum flow so as to control or reduce perturbations in the aluminum pad. Actually a single thickness of randomly or preselectively spaced $TiB_2$ pieces may possibly be used to create irregular or nonuniform flow channels but then there would not be present the desirable tortuous flow channels for the molten metal. This would result in changes in the perturbations of the aluminum pad.

It should be manifest that the use of selected randomly or regularly sized geometric configurations of $TiB_2$ avoids the necessity of dimensioning the pieces carefully as required in the prior art as exemplified in U.S. Pat. No. 4,071,420, however, it is important to maintain some minimum size of the maximum dimension of the $TiB_2$ pieces to prevent clogging of the flow channels through which the molten deposited aluminum flows. Undersirably small particles would tend to lodge in the spaces between the larger particles thus blocking off some of the flow channels and prevent the free flow of the molten metal. The minimum size of the pieces found useful is about 0.0625 inches with a minimum of about 0.25 to 0.5 inches preferred. The maximum size is not critical and can be as large as 1 to 5 inches or more.

It is preferred, but not essential, that to maintain proper sizing and control of the apertures through the bed that the particles or pieces be of regular shape and size so that the void size, total void amount and the stacking characteristics may be predicted and calculated.

The regular shapes that would be best suited for purposes of this invention are those such as spheres, regular polygons, etc. The spheres are particularly desirable in that the speherical shapes stack well and avoid sizes that are not predictable. Spherical pieces also have an inherently high resistance to impact damage such as could occur during levelling operations. Spheres however are the most compact possible shape and thus would require considerably more of the expensive $TiB_2$ per given bed thickness when compared to other possible shapes.

It is considered desirable therefore that other geometric shapes which would occupy the maximum cell volume compared to the minimum volume of $TiB_2$ may be useful. Among those shapes considered useful are the raschig ring, berl saddle and possibly the partition rings which shapes are known for use in distillation tower packing.

To lower the cost of the $TiB_2$ being used it is possible that a thin film of $TiB_2$ between 1 micron to 0.125 inches be applied to the surface of a compatible, inexpensive substrate such as graphite or carbon or the like by any convenient method such as chemical vapor deposition reactive physical vapor deposition, plasma spraying, etc. In such a manner only a small portion of the volume of the particles would be composed of $TiB_2$. The wettability characteristics and the durability of the particles would not be seriously degraded and the substantial savings in cost is a desirable feature.

If the basic particle shapes include a substrate such as graphite and a thin film of $TiB_2$ such particles may not be heavier than the molten aluminum deposited and may float on the molten aluminum 94 as shown in FIG. 13. Such a condition is not a disadvantage because the comparatively thin layer of particles 96 floating on the surface of the molten aluminum simply further reduces the total amount of the particles required and further the floating layer of particles allows the molten pool to remain at a sufficient distance from the anode to suppress magnetic perturbations in the liquid aluminum pool.

In the embodiments of FIGS. 4 and 5, the same cathode may be used for the chloride bath or the fluoride bath in the electrolytic production of aluminum from aluminum oxides.

Again like structures have been labeled with the same identifying characters. In FIG. 5 the form of the anode is somewhat different but has been found to be extremely effective and efficient in the production of aluminum.

The anode electrode 62 of any conductive material is suitably supported by means not shown and penetrates deeply into the melt 16 but remains above the molten aluminum pool 32 and the $TiB_2$ pieces 58. Surrounding the anode connector 62 are the anode raw materials 64 comprising the metal oxide materials and the reducing agent which are intimately mixed together as described above and which together with the electrode 62 form the composite anode. In this embodiment, the anode connector and the composite anode 64 are similar to the anode of FIG. 2 in that there is a central conducting anode and surrounding anodic material. This anodic mixture may be formed into small particles 64 of a size from about 0.001 inch approximately to 1.0 inch or more and may have been formed by extrusion, molding or the like and fed into the cell by the hopper 66. The raw material particles of aluminous material and reducing agent are in close contact with the anode 62 and serve the purpose of providing the necessary source of aluminum and the reducing agent in the manner as previously described.

These anodic raw materials are held in close contact with each other and with the anode connector 62 by being contained in a porous membrane container 68 which surrounds the anode connector 62. As the anode materials 64 are used up and their level drops substantially below the level of the molten bath 16, feed 66 is operated to add additional anodic materials into the porous membrane container 68.

During electrolysis the raw materials 64, assumed to be alumina and carbon in the all fluoride bath, will produce aluminum ions which pass through the porous membrane 68 into the bath 16. The undissolved impurities are retained in the membrane container 68 and are removed upon build-up by suitable means.

The combination of the anode electrode 62, the anode raw materials 64 and the membrane container 68 may be substituted for one or both of the electrodes 25 and 26 of FIG. 1 and may operate in the bipolar mode.

In FIGS. 6 to 11 there are illustrated cell designs for the combination winning and refining operations. They are each suitable for the chloride cycle system with provision for a closed top and the all fluoride bath using the open top as shown.

In FIGS. 6 and 7, the composite anode 70 is supported and positioned to be continuously fed into a low density salt bath 72. The same anodic materials previously described are useful in this cell. A membrane container 68 is supported on the refractory lining 14. A suitable quantity of molten aluminum 74 of any purity or grade is introduced into the membrane compartment. This impure aluminum layer forms an intermediate bipolar electrode between the winning compartment 73 within the membrane and the refining compartment 75 below. The refining compartment 75 is defined by the refined metal layer 76 positioned above the cathode 78 which may be of carbon, graphite, or other suitable material and the refractory sides 80.

The aluminum and whatever impurities were present in the anode are deposited on the bipolar intermediate layer 74. The aluminum ions are then preferentially transferred from the bipolar layer 74 through the membrane 68 and into the refining compartment 75 for collection in the metal pool 76. The impurities and the refined aluminum are removed by suitable means not shown.

The cells of FIGS. 8 to 11 are somewhat similar and each contain a winning zone 81 and refining zone 83 separated by a refractory dike 82. The zones or compartments are side by side but perform the same functions as described for FIGS. 6 and 7. Like figures represent like features. The major difference is that the refined aluminum 76 is collected within the membrane of FIG. 8 and the impurities are retained in the impure aluminum layer 74. The electrolyte 72 may be the same composition although there is no fluid communication of the bath between the two compartments.

In FIG. 12, the cathode may be made of any of the conductive materials specified in accordance with the present invention preferably, a material that is wetted by molten aluminum such as titanium diboride. A cathode of such conductive material is designed to penetrate through the molten aluminum layer 88 and extend down to the desired spacing "x" above the anode layer 91. As the operation of the cell continues aluminum metal is deposited on the under surface of the titanium diboride cathode as at 92 and subsequently rises through the heavier bath to become part of the molten aluminum layer 88 at the top of the cell. As the anode material is consumed optimum spacing is maintained by lowering the cathode and conversely, as anode material is replaced, the cathode is correspondingly raised. Through the determination of cell voltage the desirability of raising or lowering the cathode can easily be determined.

As an alternative a screen or grid, not shown, may be placed on top of the anode layer 89 in order to maintain the anode pieces in a preselected spaced position below the cathode.

EXAMPLES

EXAMPLE 1

In FIG. 1, the anodes are graphite plates and the cathode electrode is a titanium diboride plate. The anodes were prepared with a coating 38 as shown in FIG. 2 which consisted of Bayer Process purified $Al_2O_3$ calcined to 1000° C. and mixed in a weight proportion of five parts $Al_2O_3$ to one part carbon in the coked stage. The carbon was obtained by mixing the $Al_2O_3$ with a phenolic resin and gradually heating to 1000° C. in an inert atmosphere for coking the phenolic resin to carbon. The electrode coating was prepared by mixing the $Al_2O_3$ and phenolic, troweling or otherwise applying the mixture on the electrode, heating to coking temperature and then repeating until a thick coating layer was obtained.

The electrolyte consisted of an equimolar mixture of sodium chloride and aluminum chloride forming the double salt $NaAlCl_4$ at about 150° C. The temperature of the cell was raised to 700° C. and electrolysis of the $Al_2O_3$ conducted for several hours which produced a layer of molten aluminum on the bottom of the cell. Examination of the anode revealed that the coating had dissolved and aluminum was deposited at the cathode. This deposition of aluminum was equivalent to the aluminum content of the $Al_2O_3$ dissolved at the anode. The controlling reaction is believed to be the $Al_2O_3+C+Cl_2 \rightarrow AlCl_3+CO$ and $CO_2$. During the electrolysis there was no evidence of any chlorine gas being liberated at the anodes and in the exit tube. The exit gas was analyzed and determined to be primarily $CO_2$.

EXAMPLE 2

The electrolyte salt composition consisted of 63% NaCl, 17% LiCl, 10% LiF, 10% $AlCl_3$ and the electrode coating of FIG. 2 was prepared from standard bauxite $Al_2O_3$ and a petroleum tar pitch which was coked to produce an $Al_2O_3$ to carbon (as coked) ratio of 5.7 to 1. The electrolysis was conducted in the FIG. 1 cell at a temperature of 750° C. The spacing between anode and cathode was ½ inch which produced an electrode current density of 15 amps/in$^2$ at an imposed voltage of 2.5 volts. There was no chlorine gas detected as being released from the anode which is indicative of the $Al_2O_3$ in the bauxite reacting with the chlorine produced in the anodic cycle. Aluminum was deposited which settled to the bottom of the cell. The harvested aluminum was produced at a Faradaic efficiency of 92% with an energy consumption of 3.67 Kwh/lb.

EXAMPLE 3

The electrolyte salt composition consisted of 10% NaCl, 50% $CaCl_2$, 20% $CaF_2$, 20% $AlCl_3$. The electrode coating of FIG. 2 was prepared as in Example 2 but only on one side of the electrode. The electrical connections were made such that the anode adjacent to the exit tube was connected to the positive terminal and the negative terminal to the electrode most remote to the exit tube. The coated sides of the electrodes 25 and 26 each faced away from the exit tube and toward the cathode. Electrode 24, the cathode, was not coated. This results in electrode 25 not being physically connected to the direct current power supply. That electrode then becomes bipolar. The side coated with the $Al_2O_3$-C mixture is thus positively charged to release chlorine to form the product $AlCl_3$. The side of bipolar electrode 25 nearest the exit tube becomes negatively charged upon which aluminum is deposited and sinks into the molten pool. Aluminum also deposits on the negatively charged electrode 24 and sinks into the molten pool. The temperature of the cell operation was 800° C. and the imposed voltage was 3 volts with respect to each electrode or a total of 6 volts across the terminals. This imposed voltage with an electrode spacing of ¾ inch resulted in an electrode current density of 12 amps/in$^2$.

EXAMPLE 4

The anode electrodes were composed of titanium diboride rods and the cathode electrode was also titanium diboride. The anodes were coated with bauxite as in FIG. 2 which has been calcined at 600° C., mixed with phenolic resin, and coked at 800° C. The ratio of aluminum oxide in the bauxite to carbon after coking was 5.5 to 1. The electrolyte salt composition was 20% NaCl, 30% $CaCl_2$, 10% $CaF_2$, 4% NaF, 36% $AlCl_3$ and was operated at 750° C. at an electrode density of 15 amps/in$^2$. This resulted in 4 volts at an electrode spacing approximately ¾ inch. No chlorine gas was observed in the discharge exit port which shows that chlorine generated at the anode was reacting with the bauxite to reform metal chlorides which were then deposited as metal at the cathode. The composition of the aluminum deposited in the molten pool was 97% pure containing 0.5% Si, 1.5% Fe and 0.9% Ti with minor other constituents.

EXAMPLE 5

The electrolyte salt composition consisted of 65% $CaCl_2$, 20% $CaF_2$, 5% NaF, and 10% $AlCl_3$. The anode electrodes were as shown in FIG. 3 made an aluminum oxide to carbon ratio of 5.5 to 1 using a copper bus pin. The aluminum oxide was commercial grade Alcoa A-1 and the carbon was obtained from a mixture of phenolic and pitch which was coked to 1100° C. Electrolysis in a cell as shown in FIG. 1 produced aluminum metal that settled into the pool at the bottom of the cell. No chlorine gas was detected in the exit tube. Chlorine generated at the anode reacted with the $Al_2O_3$-carbon anode stoichiometrically with respect to the number of Faradays of electricity passed. The aluminum produced had a purity of 99.9%.

EXAMPLE 6

The electrolyte salt composition consisted of 30% NaCl, 8% LiCl, 27% $CaCl_2$, 20% $CaF_2$, 10% LiF and 5% $AlCl_3$. The anode electrodes were graphite coated with a clay mineral kaolin and carbon as in FIG. 2 to yield a ratio of 5.6 $Al_2O_3$ in the clay to 1 carbon after coking. Electrolysis yielded aluminum without any chlorine gas being detected in the exit tube while the anode coating dissolved as a result of electrolysis.

EXAMPLE 7

The electrolyte of Example 4 was used and the anode electrode of FIG. 2 was prepared by mixing bauxite and a phenolic resin in a consistency to approximate that of a viscous gel and which would yield a ratio of contained aluminum oxide to carbon of 5.5 to 1 upon coking. The bauxite-phenolic was troweled onto the graphite for use as an anode and dried to 150° C. which produced a hard coating but not one fully cured. The electrode was then gradually lowered into the salt electrolyte which was at a temperature of 780° C. After a five minute period to allow volatiles from the phenolic to escape and coking to occur, electrolysis was conducted which produced aluminum and anode dissolution without the evolution of any chlorine gas in the exit tube.

EXAMPLE 8

The instant invention may be operated with the cell of FIG. 4 and with the anode of FIG. 3 prepared as described in Example 5.

After coking, the electrode was inserted into the cell which contained an all fluoride salt electrolyte of composition 20% $AlF_3$, 50% NaF, 30% LiF. The cell temperature was adjusted to 775° C. Pieces of $TiB_2$ were added and the spacing between the anode and the surface of the $TiB_2$ pieces was adjusted to 0.5 inch. An anode current density of 6.5 amps/in$^2$ was imposed which required a voltage of 2.75 V. Electrolysis was continuous with the electrode continually being lowered to maintain an approximate 0.5 inch spacing. This was adjusted through cell temperature control and voltage. The cell efficiency was 91% and the aluminum had a purity of 99.7%. The energy consumption was 4.1 Kwh/lb.

EXAMPLE 9

The Example 8 was repeated by the spacing between the $TiB_2$ particles and the anode was about 0.25 inch. A potential of 2.0 volts is required to produce an anode current density of 6.5 amps/in$^2$. The temperature in the electrolyte was 760° C. and the cell efficiency was computed to be 90%.

EXAMPLE 10

The cell in FIG. 5 utilized a porous membrane of aluminum nitride material 3/16 inch thick having 50% porosity with a pore size in the range of 12 to 24 microns. The aluminum nitride was obtained by impregnating an alumina porous body with carbon and then heating to 1750° C. in a nitrogen atmosphere. The anode conductor was a graphite rod and the anode aluminous material was a Bayer $Al_2O_3$ and carbon mixed powder in a ratio of 5.5 to 1. The electrolyte salt composition was 20% NaCl, 25% LiCl, 30% LiF, 25% $AlCl_3$ and electrolysis was conducted at 720° C. The spacing between the membrane and the aluminum pool was approximately ½ inch and electrolysis was run at an anode current density of 10 amps/in$^2$. This resulted in a voltage of 2.8. The aluminum was produced at an efficiency of 92% and had a purity of 99.5%.

EXAMPLE 11

The porous membrane was a silicon nitride material 3/16 inch thick having a 70% porosity with a pore size in the range of 6 to 12 microns. The anode conductor was a $TiB_2$ tube with a wall thickness of ¼ inch. The anode material was prepared by mixing bauxite and pitch to produce a ratio of contained $Al_2O_3$ to carbon of 5.5 to 1 after coking. The bauxite and pitch were poured into a lined ceramic boat and heated in air until it became solid. The solid material was crushed into pieces ranging from about ¾ inch down to about ⅛ inch. These crushed pieces were slowly fed as in FIG. 5 into the anode membrane basket which allowed them to preheat and become coked by the time they reached the level of the electrolyte composition of Example 10. As the anode material was consumed in the bottom of the membrane, new material would fall down and take its place to react and form aluminum on electrolysis. The electrolysis proceeded as in Example 10.

EXAMPLE 12

The porous membrane was 80 pore 3/16 inch thick vitreous carbon coated with pyrolytic boron nitride. The anode material was Bayer $Al_2O_3$ which had been mixed with carbon powder and asphalt to yield a coked ratio of 5 to 1. The anode mixture was continuously extruded from a ½ diameter nozzle, coked and broken into pieces from ½ to 1 inch long. These prepared anode pieces were fed into the membrane basket of FIG. 5. Electrolysis was conducted with about a ½ inch spacing between the membrane and a $TiB_2$ piece in the aluminum pool. This took place at a temperature of 775° C. and utilized the electrolyte of Example 10. At a potential of 2.83 V, aluminum was produced at approximately 4.25 kwh/lb.

EXAMPLE 13

In the cell of FIG. 4, an anode that was prepared from 5.6 parts $Al_2O_3$ Alcoa alumina grade A-1, with one part carbon obtained from a mixture of phenolic and pitch and coked to 1150° C. was utilized with graphite clamps or claws. Spheroid shapes of $TiB_2$ approximately one inch in diameter were spread approximately three inches thick on the bottom of the cell. The electrolyte was the same as Example 8 and the anode distance "x" to the $TiB_2$ was adjusted to approximately 0.33 inches. The clamps were adjusted to be no more than 1.0 inch from the bottom of the anode. The anode was continuously fed into the cell and as it was consumed another anode was set on top of the first. The anode were consecutively completely consumed. Additional anodes were fed in a like manner. A potential of 2.5 V produced an anode current density of 6.5 amps/inch$^2$ which resulted in an energy consumption of 3.8 Kwh/lb.

EXAMPLE 14

A closed cell as shown in FIG. 1 was utilized with anodes as shown in FIG. 2A. The electrolyte was the same as in Example 10. The anodes were prepared as in Example 13. The anodes in the first test were 2.5 inch diameter and one primary grade purity aluminum rod ¼ inch diameter was utilized in the center of the anode. $TiB_2$ random pieces ranging from about one to 1.5 inches were utilized in the cell bottom to a depth of about three inches. The spacing was 0.5 inches which resulted in 2.6 V at an anode current density of 6.5 amps/inch$^2$ with a bath temperature of 725° C. After two hours operation the anode was removed and it was found that the ¼ in. aluminum bus rod had receded to about ¼ in. into the anode. The anode was returned to the cell and electrolized until it was consumed down to a stub of about 2 inches. When the anode stub was removed from the cell it was observed that some liquid aluminum ran out of the bus hole in the anode. It was then observed that the aluminum bus had receded to about one inch into the anode. The additional depth of recession of the aluminum bus into the anode from ¼ inch to 1 inch is probably due both to slight differences in heat transfer up the anode as the stub end is reached as well as variations in the cell temperature.

EXAMPLE 15

The cell in FIG. 12 was utilized with a closed top. The salt composition was 20% LiF, 45% $BaF_2$, 15% NaCl and 20% $AlCl_3$ and operated at 710° C. The density of the salt at temperature was about 2.49 g/cm$^3$ which results in the aluminum produced at the cathode rising and floating on the salt. The anode was formed from high pressure molded anode pieces which had a density greater than 2.5 g/cm$^3$ and therefore sank to the bottom. A $TiB_2$ cathode was adjusted to a distance "x" of 0.25 inches from the surface of the anode pieces. A potential of 3.5 V was applied to produce an anode current density of 10 amps/inch$^2$ if the anode area had been a solid anode surface. The efficiency of the run was 85% which is less than other runs with the composite anode system. It is presumed that some of the $CO_2$ liberated from the anode reaction, caused a back reaction with the aluminum in the cathode layer.

A second test was made in which the anode pieces of less density than the salt electrolyte and a graphite grate was utilized to hold the anode pieces on the bottom. Also, a trough was used at the top of the salt principally to keep the cathode aluminum pool out of the path of the liberated $CO_2$ from the anode reaction. In this case, results were obtained identical to those of Example 10.

EXAMPLE 16

The cell in FIG. 13 was utilized with a salt composition the same as Example 8. The anode was constructed the same as in Example 13. The $TiB_2$ spheres were prepared by chemically vapor depositing in a conventional manner a 0.005 inch coating of $TiB_2$ onto a high expansion coefficient graphite sphere, one inch in diameter. The $TiB_2$ coated spheres were added to a depth of two spheres thick which floated on the surface of the aluminum cathode pool. The purpose of the sphere in a production size cell would be to inhibit undulations in the cathode aluminum pool surface due to magnetic field effects. The anode was adjusted to 0.25 inches from the $TiB_2$ spheres surface and a potential of 3.4 V was applied to give an anode current density of 12 amps/inch$^2$ at a bath temperature of 710° C. The deposited aluminum on the $TiB_2$ coated spheres wets the $TiB_2$ surface and then runs down into the cathode pool. The $TiB_2$ spheres continue to float and prevent magnetic perturbations in the cathode aluminum pool. It should be noted the composite anode is consumed uniformly and without sludge which does not result in the mulk that forms in traditional Hall-Heroult cells which builds up on the bottom of the cell clogging the $TiB_2$.

EXAMPLE 17

The electrolyte of example 4 is utilized and is introduced into the cell illustrated in FIG. 6. Sufficient molten electrolyte is added so as to fill the bottom (refining) compartment and at least half fill the top (winning) compartment. Molten aluminum of any grade is introduced into the membrane vessel of the winning compartment in an amount sufficient to cover the bottom of said membrane vessel to a depth of approximately two inches. The anode material is bauxite mixed with a phenolic resin-pitch mixture in an amount so as to yield a contained $Al_2O_3$ to carbon ratio of 4.5 to 1 upon coking. The anode is lowered into the winning compartment bath so as to attain a separation of 0.5 inch between the lower face of the anode and the upper surface of the impure molten aluminum layer.

The cell is adjusted to a temperature of 720° C. and electrolysis begun. As electrolysis is performed, this layer acts as a bi-polar electrode, selectively passing on aluminum ions at its anodic side which are then ultimately redeposited as purified aluminum metal at the refining compartment cathode at the bottom of the cell. For long term electrolysis, during which the impure bi-polar layer may become partially depleted of aluminum, increments of any convenient grade of molten aluminum are added to the membrane vessel as needed.

EXAMPLE 18

The electrolyte of example 4 is utilized and is introduced into the cell illustrated in FIG. 8. Sufficient molten electrolyte is added so as to at least half fill both compartments of the cell. Molten aluminum of any grade is added to the cell in an amount sufficient to completely cover the common bottom of the two compartments and to attain a depth sufficient to isolate the two compartments from each other. At least the bottom 2 inches of the separating dike are immersed in the molten aluminum.

The anode is prepared the same way as in example 17 and is lowered into the winning compartment until a separation of 0.5 inch between the lower face of the anode and the upper surface of the common impure molten aluminum layer is attained. A membrane vessel containing purified molten aluminum is introduced into the refining compartment until a separation of 0.5 inch between the lower face of the membrane and the upper surface of the common impure molten aluminum layer is attained. A graphite cathode is inserted into the membrane vessel and electrolysis begun. Cell temperature is as in example 17. Reaction at the anode is as in example 17, the aluminum ions thus formed are deposited as the metal at the common impure molten aluminum layer which acts as a bipolar electrode selectively releasing, in turn aluminum ions which are redeposited as aluminum metal at the cathode within the membrane vessel.

EXAMPLE 19

A molten electrolyte consisting of 60% $BaCl_2$, 23% $AlF_3$ and 17% NaF is introduced into the cell illustrated in FIG. 10. Sufficient electrolyte is added so as to achieve a depth of from 4 to 6 inches in both compartments of the cell. A molten alloy consisting of 70% aluminum and 30% copper is added to the cell in an amount sufficient to completely cover the common bottom and isolate the two compartments. At least the bottom two inches of the separatory dike are immersed in the molten alloy layer. An anode prepared as in example 17 is lowered into the winning compartment until a separation of 0.5 inch between the lower face of the anode and the upper surface of the common molten alloy layer is attained. A layer of high purity molten aluminum is carefully added to the refining compartment so as to avoid mixing with the alloy layer on the bottom. Molten high purity aluminum, being lighter than the bath, floats at the top of the refining compartment. A graphite cathode is inserted into the molten high purity layer and electrolysis begun. $Al_2O_3$ at the anode reacts to form aluminum ions which are subsequently deposited as metal at the cathodic face of the bi-polar intermediate alloy layer. This layer in turn selectively provides aluminum ions at its anodic face which are ultimately redeposited as metal at the floating high purity aluminum cathodic layer. The purified aluminum layer is separated from the bi-polar intermediate layer by the molten electrolyte. Cell operating temperature is 720° C.

We claim:

1. An electrolytic cell for the production of aluminum comprising in combination, a housing having first and second compartments, a molten electrolyte containing ions selected from the group consisting of chlorides, fluorides or mixtures thereof in said compartments, a cathode in one of said compartments for the formation of molten metallic aluminum, an anode in the other of said compartments comprising an oxygen containing compound of aluminum in an amount sufficient to provide aluminum ions during electrolysis and a reducing agent in intermixed contact with said oxygen containing compound of aluminum, said electrolyte being of a material in which said compound will not readily dissolve in substantial quantities when the temperature of the electrolyte is in the range of 650° to 900° C., a porous membrane separating said first and second compartments, said membrane being of a material having a connected pore size sufficiently small to screen out said intermixture of said compound of aluminum and said reducing agent and sufficiently large to pass said aluminum ions, and a layer of impure aluminum forming a bipolar electrode disposed within said other compartment positioned between said anode and said cathode and supported by said membrane.

2. A cell of claim 1 wherein said anode comprises at least one longitudinally disposed central conductive material surrounded by anodic material containing said compound of aluminum.

3. The cell of claim 1 wherein said compartment containing the bipolar electrode comprises a winning zone and said one compartment containing said cathode comprises a refining zone.

4. An electrolytic cell for the production of aluminum comprising in combination, a molten halide electrolyte containing aluminum ions and ions selected from the group consisting of chlorides, fluorides or mixtures thereof, a cathode for the formation of molten metallic aluminum, an anode for reaction within said electrolyte comprising an oxygen containing compound of aluminum in an amount sufficient to provide aluminum during electrolysis and a reducing agent in intermixed contact with said oxygen containing compound of aluminum and present in an amount sufficient to react at the anode site so as to produce aluminum ions in the electrolyte for reduction at the cathode into aluminum metal and constituting the sole source of input aluminum ore, said electrolyte being of a material in which said compound does not readily dissolve in substantial quantities when the temperature of said electrolyte is in the range of 650° to 900° C. to maintain said electrolyte relatively free of the dissolved compound of aluminum, an electrode positioned between said anode and cathode, said electrode being covered on one side only with said compound and said reducing agent and being in electrical contact with said compound of aluminum and said reducing agent for bipolar electrolysis.

5. The cell of claim 4 including, said oxygen compound of aluminum being intermixed with said reducing agent in the amount of 1.5 to 50.0 parts by weight of $Al_2O_3$ per part reducing agent.

6. The cell of claim 4 including, said reducing agent being selected from the group consisting of carbon and a carbon containing reducing gas.

7. The cell of claim 4, 5 or 6 including said electrolyte comprising substantially all fluoride salt, and the temperature of the electrolyte is between about 700° to 800° C.

8. The cell of claim 4 including, said reducing agent being selected from the group consisting, of carbon and a carbon containing reducing gas, said oxygen compound of aluminum being intermixed with said reducing agent in the amount of 1.5 to 20.0 parts by weight of $Al_2O_3$ per part reducing agent, said electrolyte being substantially all fluoride salt, and the temperature of the electrolyte is between about 700° and 800° C.

9. An electrolytic cell for the production of aluminum comprising in combination, an electrolyte disposed at a predetermined level in the cell, said electrolyte including ions selected from the group consisting of chlorides, fluorides or mixtures thereof, a cathode immersed in the electrolyte presenting a surface for electrolytic winning of molten aluminum, an anode comprising a body of an anodic mixture of an oxygen containing compound of aluminum and an electrically conductive reducing agent held together in anodic contact which serves as the sole source of aluminum ore and is consumable in the elctrolytic production of aluminum, said anode including at least a portion thereof immersed in the electrolyte with at least one active surface of said portion positioned in opposed relationship to but spaced from the surface of said cathode for providing an active anode surface at which the aluminum oxide may be converted to aluminum ions recoverable as said molten aluminum at the opposing surface of said cathode, conductor means of higher electrical conductivity than said anodic mixture, said conductor means extending internally through the said portion of said anodic mixture below the level of said electrolyte and having an end thereof positioned at least approximately adjacent said one active surface for providing short, low resistant current paths from said end of said conductor means through the mixture to said active surface, means for connecting a source of electrical power to said conductor means and said cathode, said conductor means being of a material and cross-section for conducting substantially the entire anodic current directly from said power source to at least the mixture adjacent the end of said conductor means and to said active surface while maintaining the end of said conductor means relative to said active anode surface substantially unchanged as said anodic mixture at said active surface is consumed in the electrolytic process.

10. The electrolytic cell of claim 9 wherein the material of said conductor means comprises aluminum of a cross-section proportioned to prevent said aluminum from melting into the electrolyte during the electrolytic production of said molten aluminum at a rate substantially in excess of the rate at which said anodic mixture is consumed.

11. The electrolytic cell of claims 9 or 10 wherein said conductor means comprises a plurality of conductors extending through said anodic mixture and spaced from each other a distance in the range of 1 to 6 inches.

12. The electrolytic cell of claim 9 where said anodic mixture comprises particles of aluminum oxide and said reducing agent, a membrane containing said particles with said membrane having a pore structure of a size to prevent passage of said particles through the membrane but to permit free pasage of ionic aluminum and electrolyte for reaction of the particles within said electrolyte at said active surface.

13. The cell of claims 1 or 12 wherein said membrane is formed from a material selected from the group consisting of a vitreous carbon foam, graphite or carbon solid, the nitrides of boron, aluminum, silicon (including the oxynitride), titanium, hafnium, zirconium and tantalum; the silicides of molybdenum tantalum and tungsten; the carbides of hafnium, tantalum, columbium, zirconium, titanium, silicon, boron and tungsten; and the borides of hafnium, tantalum, zirconium, columbium, titanium, and silicon.

14. The electrolytic cell of claim 9 and further including a layer of loose pieces of conductive refractory hard metal associated with said cathode, said pieces having structural shapes forming irregular flow channels between adjacent pieces to permit the flow of molten aluminum to a collecting pool thereby preventing the molten aluminum from changing the anode to cathode spacing distance.

15. The cell of claim 14 wherein said pieces have shapes such as spheres, regular polygons or the like of a minimum dimension of about 0.0625 inches.

16. The cell of claim 15 with said pieces being superposed and forming layers at least two pieces thick.

17. The cell of claims 15 or 16 wherein said pieces comprise a carbon containing substrate coated with a thin film of $TiB_2$.

18. The electrolytic cell of claim 9 and further including means for replenishing the portion of said anodic mixture immersed in the electrolyte as it is consumed.

19. The cell of claim 18 wherein said replenishing means comprises means for advancing said anodic mixture toward said cathode surface.

20. The cell of claim 19 wherein said anodic mixture comprises loose particles, compartment means for containing said particles and holding them in anodic contact with said conductor means, said replenishing means comprising means for feeding additional particles of said mixture into said compartment means as said mixture at said active surface is consumed.

21. The cell of claim 19 wherein said conductor means is bonded to said mixture and advances with said mixture.

22. The cell of claims 9, 14, 18 or 21 wherein said active anode surface is spaced from said cathode surface a distance on the order of 1 inch or less.

* * * * *